US005704081A

United States Patent [19]

Bollinger

[11] Patent Number: 5,704,081

[45] Date of Patent: Jan. 6, 1998

[54] APPARATUS AND METHOD FOR PATIENT MANIPULATION DURING SURGERY

[75] Inventor: Stephen A. Bollinger, Carpinteria, Calif.

[73] Assignee: Mentor Corporation, Santa Barbara, Calif.

[21] Appl. No.: 792,774

[22] Filed: Feb. 3, 1997

[51] Int. Cl.[6] ..... A61G 7/10

[52] U.S. Cl. ..... 5/81.1 T

[58] Field of Search ..... 5/81.1 T, 81.1 R, 5/81.1 HS, 625, 626, 627, 922

[56] References Cited

U.S. PATENT DOCUMENTS

| | | | |
|---|---|---|---|
| 41,358 | 1/1864 | Bevis . | |
| 683,264 | 9/1901 | Flemister . | |
| 722,456 | 3/1903 | Reeves | 5/627 |
| 1,126,611 | 1/1915 | Wright . | |
| 1,334,901 | 3/1920 | Higdon | 5/81.1 T |
| 2,001,252 | 5/1935 | Johnston | 5/236.1 |
| 2,309,464 | 1/1943 | Lucci et al. . | |
| 2,350,573 | 6/1944 | Smith, Jr. et al. | 5/627 |
| 2,489,828 | 11/1949 | Springer . | |
| 3,158,875 | 12/1964 | Fletcher . | |
| 4,211,218 | 7/1980 | Kendrick . | |
| 4,446,796 | 5/1984 | Wilson et al. | 108/69 |
| 4,536,903 | 8/1985 | Parker | 5/81.1 T |
| 4,700,416 | 10/1987 | Johansson | 5/81.1 T |
| 4,716,607 | 1/1988 | Johansson | 5/81.1 T |
| 4,744,115 | 5/1988 | Marchione | 5/81.1 T |
| 4,793,008 | 12/1988 | Johansson | 5/81.1 T |
| 5,005,231 | 4/1991 | Lonardo | 5/81.1 T |
| 5,058,575 | 10/1991 | Anderson | 128/875 |
| 5,121,756 | 6/1992 | Koledin | 5/628 |
| 5,138,731 | 8/1992 | Harcrow, Jr. | 5/625 |
| 5,155,874 | 10/1992 | Kershaw | 5/81.1 T |
| 5,165,122 | 11/1992 | Phalen | 5/81.1 T |
| 5,475,880 | 12/1995 | Guenther | 4/578.1 |

*Primary Examiner*—Alexander Grosz
*Attorney, Agent, or Firm*—Fish & Richardson P.C.

[57] ABSTRACT

A method of manipulating the position of a patient during surgery is disclosed. The method includes providing a patient manipulation device having a plurality of hinged segments. A patient is placed in a first position on the device such that the length of the patient's body is parallel to an axis of rotation of the hinged segments. One of the segments is lifted to rotate the patient about the length of the patient's body to a second position on the device. In one embodiment, the patient manipulation device includes a plurality of elongated, substantially rigid patient support segments each of which has a width substantially as large as a width of a surgical table with which the device is used. The segments have longitudinal axes arranged parallel to each other and are joined together by hinges configured for rotation of the segments about the length of the patient's body.

17 Claims, 7 Drawing Sheets

APPARATUS AND METHOD FOR PATIENT MANIPULATION DURING SURGERY

BACKGROUND

This invention relates to surgery, and more specifically to a patient manipulation device and a method of manipulating a patient undergoing surgery (e.g., lipoplasty) from one position to another.

The surgical technique of lipoplasty involves removing unwanted fatty deposits by separating the fat from surrounding tissue and aspirating the fat through a probe. The probe is inserted, through an incision made in the patient's skin, into a region of fat located between the skin and the underlying muscle. Typically, the patient is either heavily sedated or fully anesthetized during the procedure. The sedated or anesthetized patient is positioned on a surgical table (e.g., in a supine position) such that a surface of the patient's body (e.g., the front surface) is accessible to the surgeon performing lipoplasty. Because lipoplasty is often performed at multiple sites on different body surfaces of the same patient, the patient must be maneuvered into various positions to access the sites during the procedure.

SUMMARY

One general aspect of the invention is a method of manipulating the position of a patient during surgery. The method includes providing a patient manipulation device having a plurality of hinged segments, placing the patient in a first position on the device such that the length of the patient's body is parallel to an axis of rotation of the segments, and lifting one of the segments to rotate the patient about the length of the patient's body to a second position on the device.

Preferred embodiments may include one or more of the following features.

Another one of the segments is folded over an edge of a surgical table on which the device and the patient are supported. During lifting, one of the segments is displaced from beneath the patient and replaced with another of the segments while rotating the patient from the first position to the second position. The segment is lifted using a handle on the segment.

To manipulate the patient further, another segment is lifted to rotate the patient about the length of the patient's body to a third position on the device. The first position is either prone or supine and the second position is a side-lying position.

In one embodiment, the patient is lifted by wrapping some of the segments partially around the patient's body. In another embodiment, one of the segments is maintained in contact with the patient's body substantially across the width of the body during lifting. In either embodiment, the patient is secured in the first or second position by reversibly coupling a pad to the device adjacent the patient.

Another general aspect of the invention features a patient manipulation device for manipulating the position of a patient on a surgical table. The patient manipulation device includes a plurality of elongated, substantially rigid patient support segments each of which has a width substantially as large as a width of the table, and the segments have longitudinal axes arranged parallel to each other; adjacent segments are joined together by hinges configured for rotation of the segments about the length of the patient's body.

Preferred embodiments may include one or more of the following features.

The hinges are substantially rigid and are configured for bidirectional rotation of the segments. The hinges are configured for rotation of at least about 180° degrees about the length of the patient's body. In one embodiment, the width of each segment is at least about 25% greater than the width of the table; in another embodiment, each segment has a width of at least about 50% greater than the width of the table. A handle is disposed on one of the segments. Preferably, a pad is reversibly coupled to one of the segments to secure the position of a patient on the device.

Among other advantages, the patient manipulation device and method of manipulating significantly reduce the difficulty associated with maneuvering a patient, particularly a large patient under general anesthesia. Each hinged segment functions as a lever to reduce the force required to move the patient. This, in turn, reduces the likelihood of injury (e.g., lower back injury) to operating room personnel associated with patient maneuvering. The handles further ease the task of lifting of the segments by enabling operating room personnel to more securely grip the segments. Moreover, the device is lightweight and adds little to the force required for moving the patient.

Because the patient is not lifted, but instead is rotated from side to side, the risk of bruising the patient during maneuvering is significantly reduced. Moreover, the patient manipulation device is also compatible with the equipment, space, and functional constraints imposed by a standard surgical suite. For example, the hinges of the device allow the segments which are not supporting the patient to fold or drape down over the edges of a standard surgical table. This features allows operating room personnel to stand close to the patient and maintains the accessible floor space in the surgical suite.

Because the patient may easily be maneuvered from one position to another, the surgeon's access to multiple sites for surgery is enhanced, thereby enabling surgical procedures such as lipoplasty to be performed more completely. As a result, the need to perform multiple individual procedures may be reduced. In addition, the risk of displacing anesthesia lines, EKG leads, and the like from the patient is diminished.

Other features and advantages of the invention will become apparent from the following detailed description, and from the claims.

DRAWINGS

FIGS. 1A and 1B are perspective views of the opposite sides of a patient manipulation device used during surgery.

FIG. 2A, 2B, and 2C are perspective views of the patient manipulation device of FIG. 1 in use.

DESCRIPTION

Figure 1A:
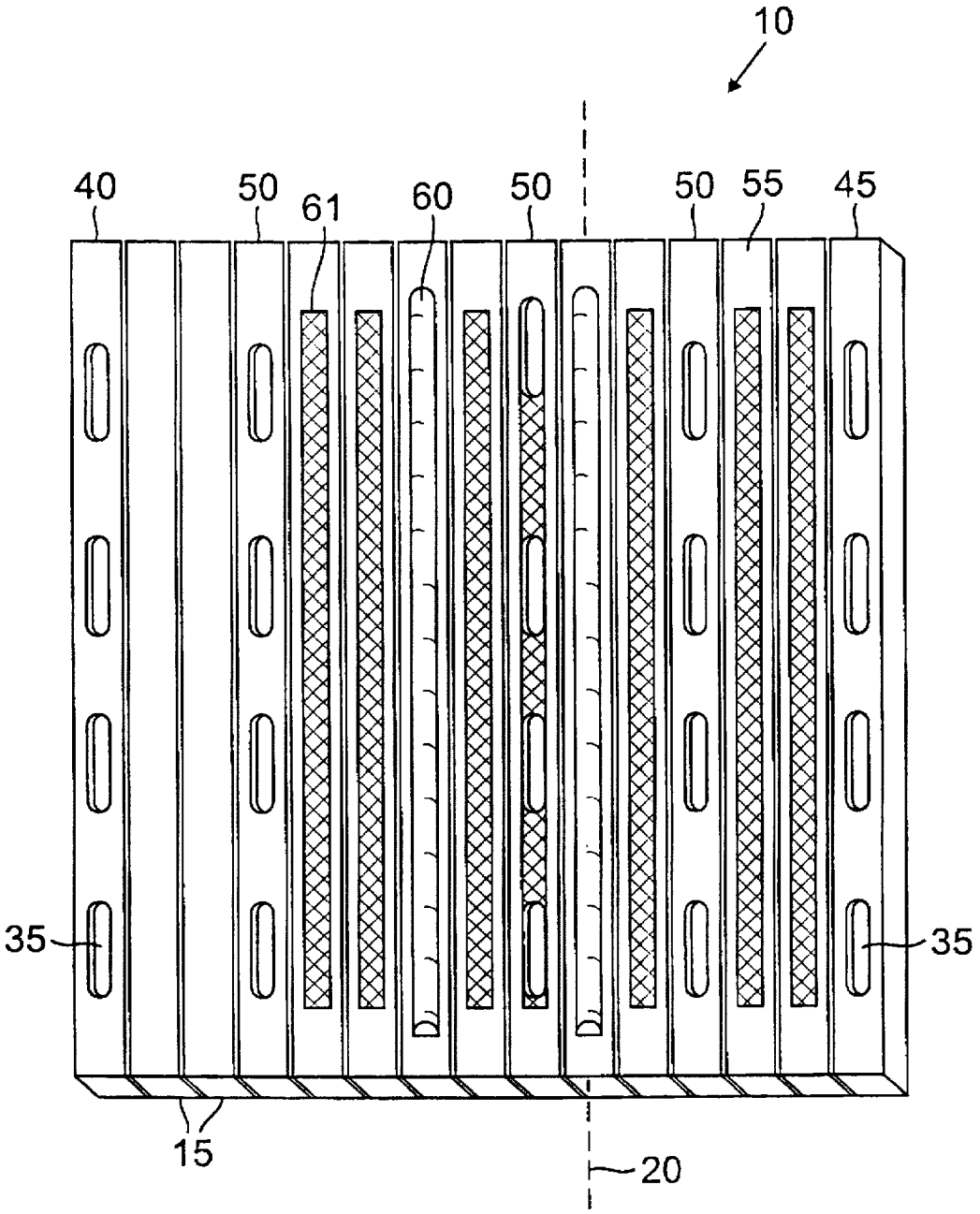
Figure 1B:
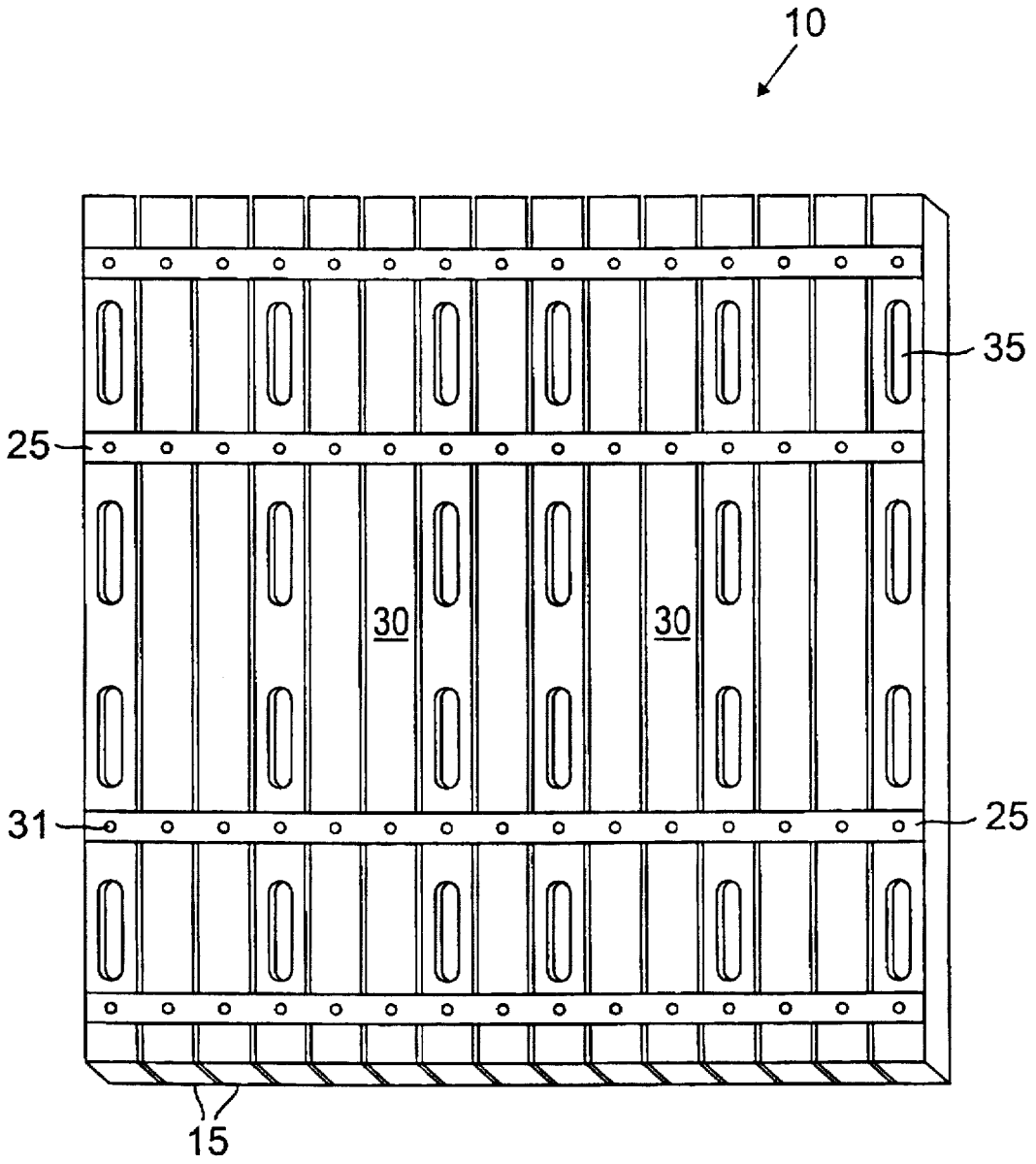

Referring to FIGS. 1A and 1B, patient manipulation device 10 for use during surgery includes multiple elongated patient support segments 15 having longitudinal axes 20 in parallel alignment. Patient support segments 15 are relatively narrow (e.g., each having a width substantially less than the width of a surgical table on which the device is positioned) and substantially rigid slats. Patient support segments 15 are joined by hinge straps 25 secured to back surface 30 of device 10 by rivets 31. Hinge straps 25 allow patient support segments 15 to rotate approximately 180° about their longitudinal axes 20.

Rotation of patient support segments 15 by operating room personnel is facilitated by handles 35 which extend through left outermost patient support segment 40, right outermost patient support segment 45, and several intermediate patient support segments 50. Front surface 55 of several of intermediate patient support segments 50 includes VELCRO™ strips 61 (e.g., the female side) for the attachment of patient stabilization pads 60 (see discussion below) having the opposite VELCRO™ strips (e.g., the male side). Patient manipulation device 10 is approximately six feet in length and six feet in width. Individual patient support segments 15 are approximately four inches wide and two inches thick. Hinge straps 25 are preferably canvas web straps approximately four inches in width.

Figure 2A:
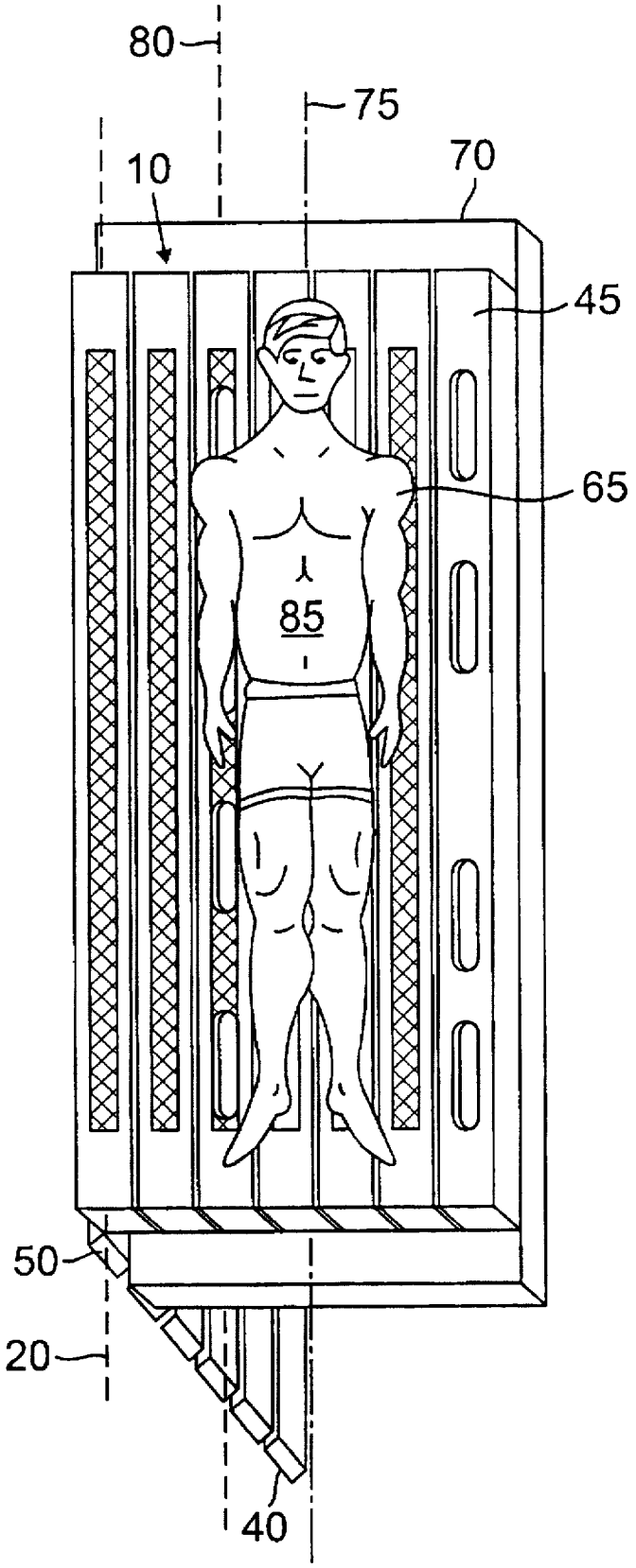

Referring to FIG. 2A, in use, patient manipulation device 10 is placed between patient 65 and surgical table 70 so that the length of the patient's body 75 and the longitudinal axes of table 80 and segments 20 are parallel. A sterile surgical drape (not shown) is placed between patient 65 and device 10 to maintain an aseptic environment for the surgical procedure. Because device 10 is wider than surgical table 70, and segments 15 are rotatable with respect to each other, left outermost patient support segment 40 and several intermediate patient support segments 50 drape over the side of surgical table 70. Once patient 65 has been positioned (e.g., in a supine position) and prepped for the procedure, the surgeon has access to surgical sites (e.g., lipoplasty sites) on the exposed surface (e.g., front surface 85) of the patient's body.

Figure 2B:
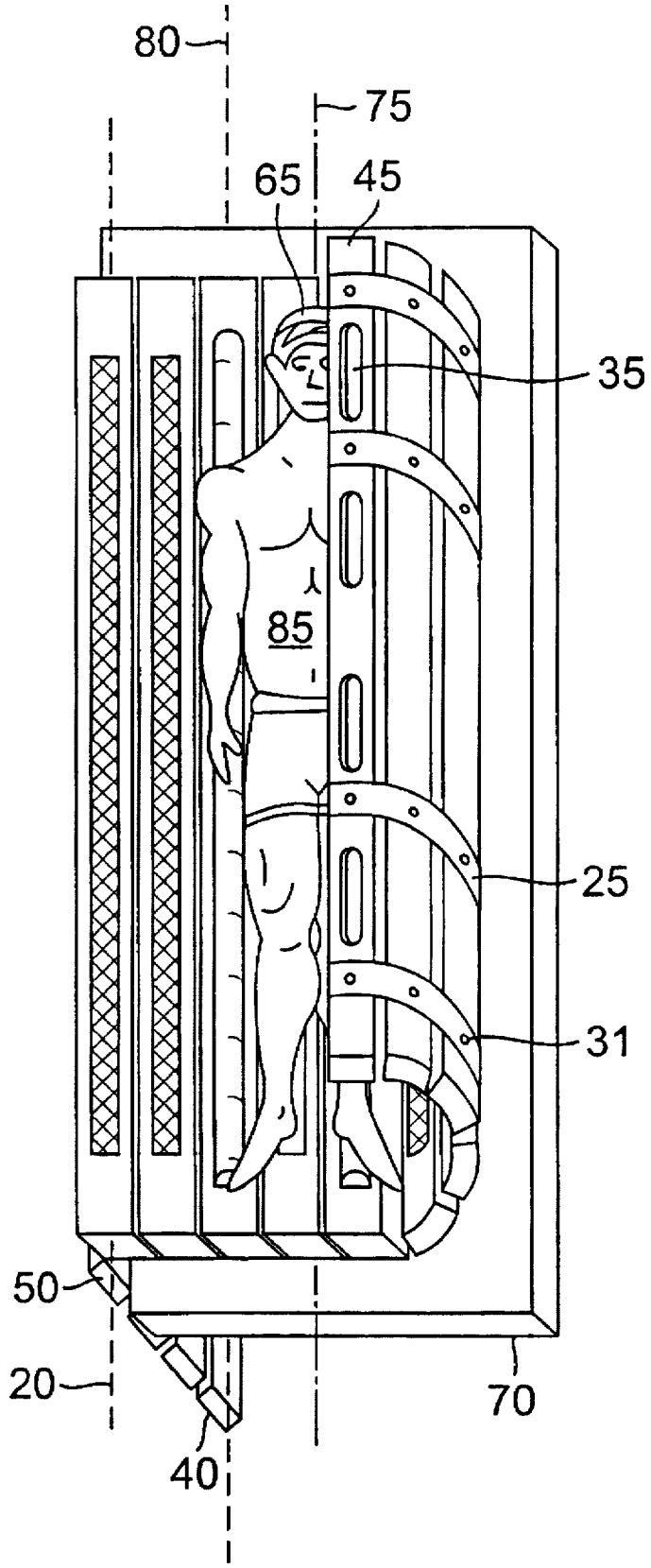
Figure 2C:
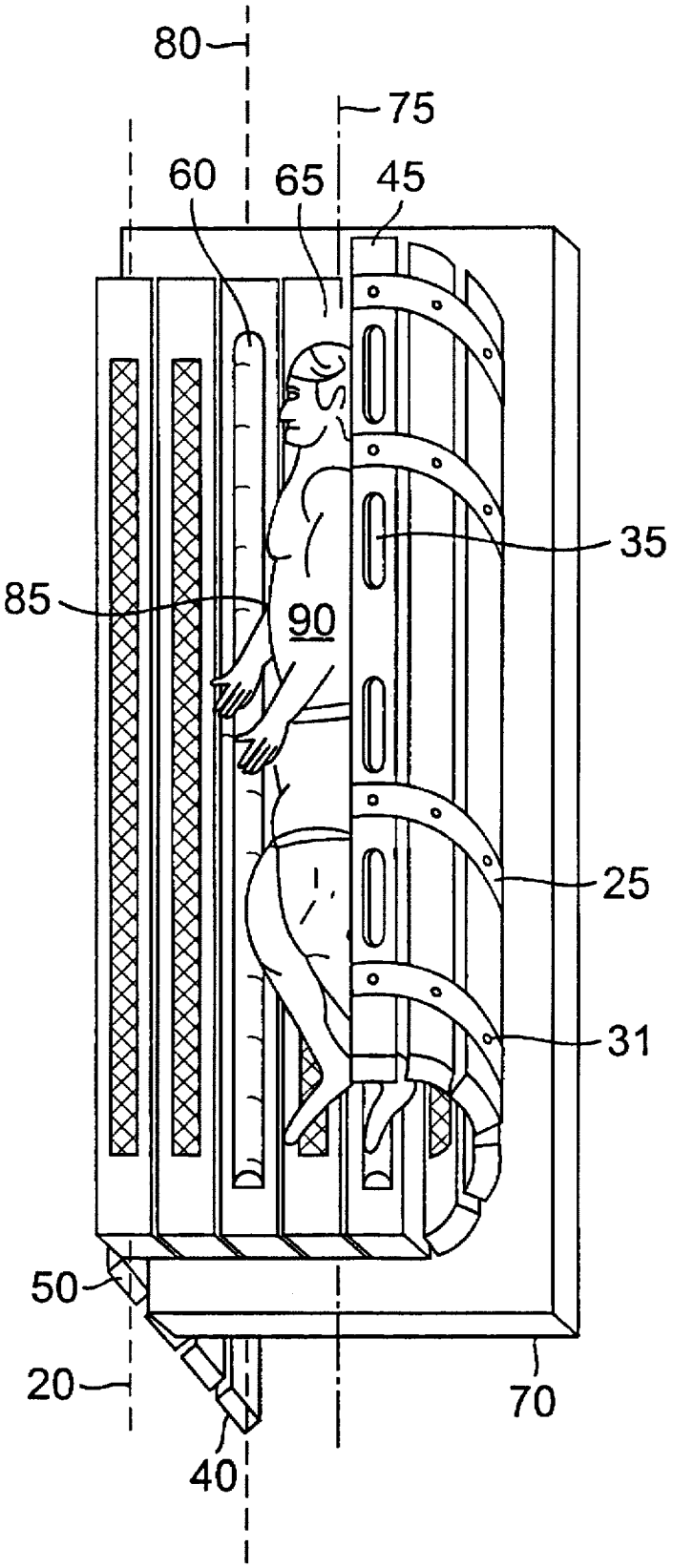

Referring to FIGS. 2B and 2C, when the surgeon desires to access surgical sites on an unexposed surface (e.g., the left side surface 90), patient 65 is repositioned by rotating the patient approximately 90° about the length of his or her body 75. Operating room personnel may easily rotate patient 65, even a large patient 65 under general anesthesia, by first grasping handles 35, wrapping segments 15 (i.e., from the side of the patient opposite the direction of rotation) partially around patient 65, and then pushing patient 65 with device 10 into a side-lying position (see FIG. 2C).

In addition, rotation is facilitated by individual patient support segments 15 of device 10 which serve as multiple levers, each bearing only a portion of the patient's total body weight. Rotation is also aided by incrementally sliding patient support segments 15 to a position under patient 65 (e.g., from the same side of the patient as the direction of rotation). Sliding of segments 15 is accomplished by grasping and pulling an available intermediate handle 35 with one hand, while pushing patient 65 with the opposite hand as described above.

In addition, other operating room personnel may push patient support segments 15 to a position under the patient (e.g., from the same side of the patient as the direction of rotation). Maintenance of patient 65 in a side-lying position is facilitated by securing stabilization pads 60 adjacent the patient's front 85 and back (not shown) via VELCRO™ strips 61 (see FIG. 2C). The surgeon now has access to sites on the patient's left side surface 90 (see FIG. 2C).

Referring to FIG. 2C, when the surgeon desires to access another unexposed surface of the patient (e.g., the rear surface; not shown), stabilization pads 60 are removed and patient 65 is again rotated approximately 90° about the length of his or her body 75 (e.g., to a prone position) as described above. Subsequent access to the patient's left side surface 90, front surface 85, or right side surface (not shown) is accomplished simply by rotating the patient in the opposite direction in increments of approximately 90° about the length of his or her body 75 by reversing the process described above.

Other embodiments are within the scope of the following claims.

Figure 3:
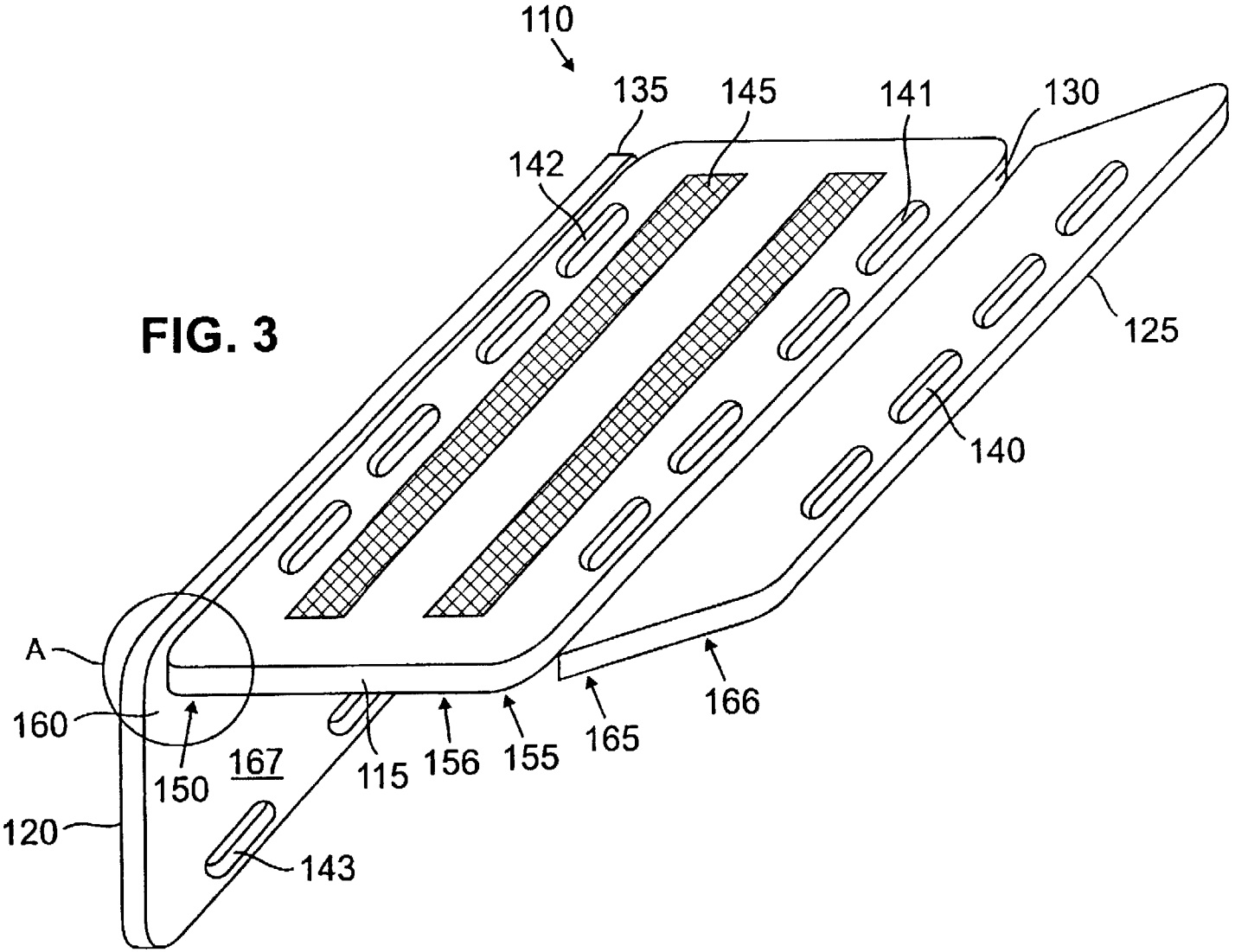
FIG. 3 is a perspective view of a patient manipulation device used during surgery.

For example, referring to FIG. 3, in one alternative embodiment, a patient manipulation device 110 for use during surgery includes three substantially rectangular, substantially rigid patient support segments 115, 120, 125 which are joined together by substantially rigid hinges 130, 135. In contrast to device 10, patient support segments 115, 120, 125 of device 110 are relatively broad; for example, the width of each segment 115, 120, 125 is substantially as large as that of a surgical table on which the device is positioned. Rotation of the segments about hinges 130, 135 by operating room personnel is facilitated by a plurality of handles 140, 141, 142, 143 which extend through patient support segments 115, 120, 125.

Patient support segments 115, 120, 125 also include VELCRO™ strips 145 for attaching VELCRO™-backed pads (not shown; see FIG. 2B) which secure a patient's position on device 110. Lateral edges 150, 155 of bottom surface 156 of middle patient support segment 115 are coupled by hinges 130, 135 to medial edges 160, 165 of bottom surfaces 166, 167 of left and right patient support segments 120, 125, respectively.

Figure 4:
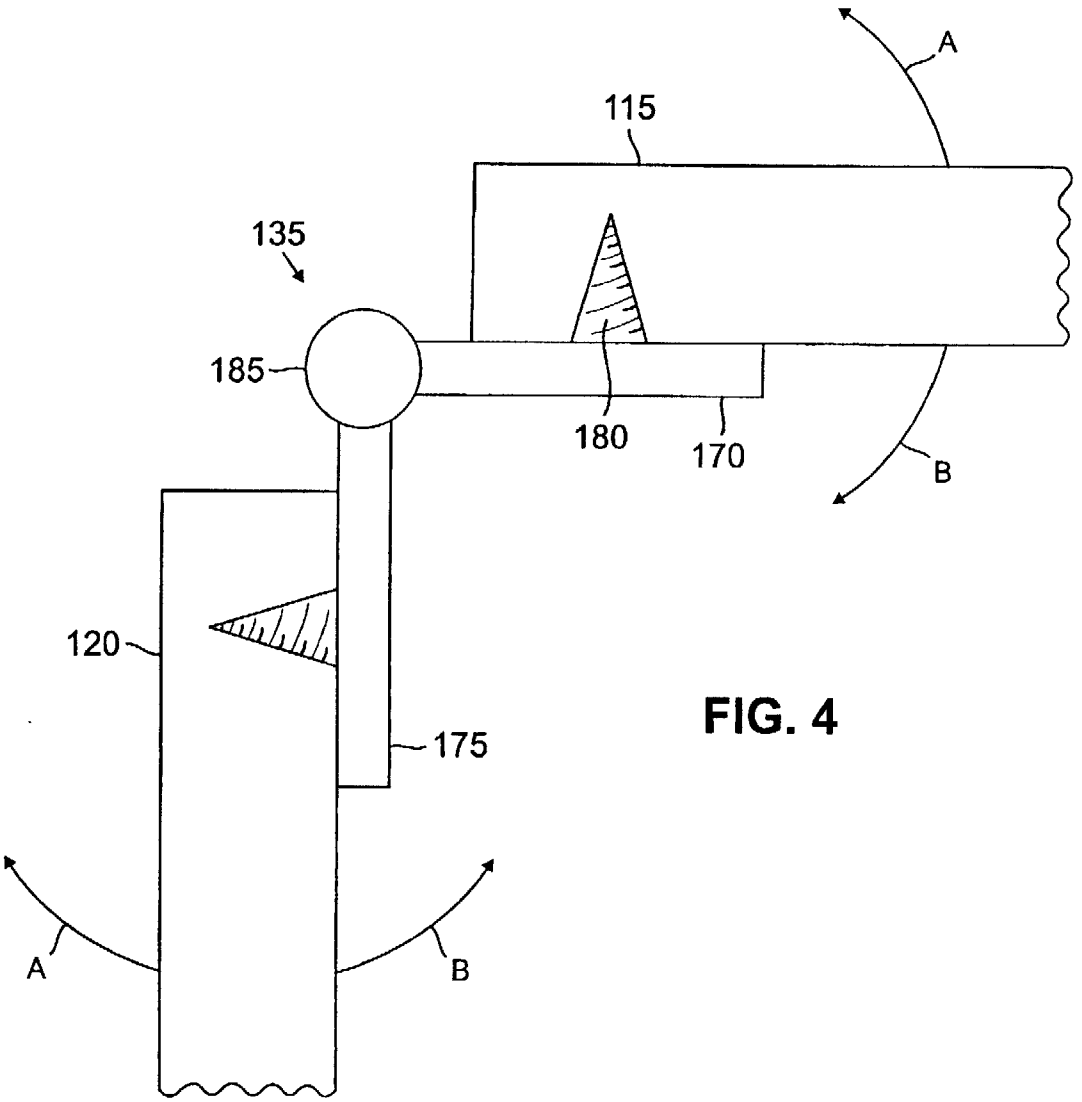
FIG. 4 is an exploded view of area A of the patient manipulation device of FIG. 3.

Referring to FIG. 4, middle segment 115 is coupled to left segment 120 by hinge 135 (and likewise to right segment 125 by hinge 130, not shown). Hinge coupling plates 170, 175 are secured with screws 180 to middle and left segments 115, 120, respectively. Coupling plates 170, 175 are joined at hinge pin 185 so that middle and left segments 115, 120 are rotatable bidirectionally (see arrows A and B) about their longitudinal axis. The bidirectional rotation of left right and segments 120, 125 about middle segment 115 allows the segments to be used as levers to rotate the patient to a new position. Once the patient has been repositioned, the segments which are not underneath the patient are draped over (i.e., hang down) the side of the surgical table (not shown; see FIGS. 2A–2C).

In use, middle segment 115 of patient manipulation device 110 is placed on top of a standard surgical table. The patient is then laid in a first position (e.g., in a supine position) on middle segment 115, such that the length of the patient's body and the longitudinal axis of middle segment 115 are parallel. Surgery is then performed at sites on the exposed surface (e.g., the front surface) of the patient's body. Once the surgeon is finished at these sites, the patient is moved into a new position (e.g., a right side-lying position) which provides access to additional sites (e.g., the left side surface) for surgery.

Operating room personnel move the patient by first grasping handles 141 on middle segment 115 (i.e., on the edge opposite the direction in which the patient will be rotated). Simultaneously, other operating room personnel grasp handles 143 of left patient support segment 120 (i.e., the segment on the same side of the patient as the direction of rotation). The patient is then rotated approximately 90° about the length of his or her body by operating room personnel simultaneously lifting middle segment 115 by handles 141 (the broad width of segment 115 enables it to be maintained in contact with the patient's body substantially across the width of the body as the patient is being rotate), pulling middle segment 115 out from underneath the patient, and pulling left segment 120 to a position underneath the patient. At the same time, other operating room personnel may assist by grasping handles 143, lifting left segment 120 until it is parallel with the surface of the surgical table, and then pushing left segment 120 underneath the patient. The patient is now in a right side-lying position, and surgical sites (e.g., lipoplasty sites) on the left side surface of the patient's body are accessible to the surgeon.

The patient is returned to the original position (e.g., the supine position) by reversing the steps described above. The patient is placed in the left side-lying position (e.g., right side surface accessible) by repeating the steps in the opposite direction (e.g., using handles 142 of middle segment 115 and handles 140 of right segment 125).

Where access to both the front and the back surfaces of the patient's body is required, left segment 120 of patient manipulation device 110 is placed on the surgical table with middle and right segments 115, 125 draped over the edge of the surgical table. The patient is then laid in a first position (e.g., in a supine position) on top of left segment 120, essentially as described above. After a first rotation of approximately 90° about the length of the patient's body (e.g., using the technique detailed above), the left side surface of the patient is accessible. A second rotation of approximately 90° in the same direction places the patient in the opposite position from which he or she was originally placed on the surgical table (e.g., in a prone position).

The patient is returned to the original position (e.g., the supine position) by reversing the steps described above. In this way, the surgeon has access to the front, back, and left side surfaces of the patient. Where access to the front, back, and right side surfaces is desired, the patient is positioned on right segment 125, with middle and left segments 115, 120 draped over the edge of the surgical table. The position of the patient, and, thus, the accessible surface of the patient's body, may be manipulated essentially as described sleeve.

In other embodiments, hinge straps 25 (FIG. 1B) may include short individual straps securing only adjacent patient support segments 15. Alternatively, rigid hinges disposed between each of the patient support segments 15 may substituted for hinge straps 25. In either of these embodiments, the adjacent lateral edges of patient support segments 15 may be rounded to facilitate a greater range of motion of the hinged segments relative to each other. In other embodiments, handles 35 and 140, 141, 142, 143 may be coupled to the lateral surfaces of outermost patient support segments 15 and to left and right segments 120, 125, respectively. The handles may be provided by hardware mounted to the segments, rather than as openings formed in the segments.

In further embodiments, the width of segments 15 may be less than about 50% of the width of a surgical table on which the patient manipulation device 10 is positioned. Alternatively, the width of segments 15 may be less than about 25% of the width of the surgical table. Alternatively, the width of segments 15 may be less than about 10% of the width of the surgical table.

In still further embodiments, the width of each segment 115, 120, 125 may be at least about 10% greater than the width of a surgical table on which the patient manipulation device 110 is positioned. Alternatively, the width of each segment 115, 120, 125 may be at least about 25% greater than the width of the surgical table. Alternatively, the width of each segment 115, 120, 125 may be at least about 50% greater than the width of the surgical table.

While the invention has been described generally in terms of traditional lipoplasty, the invention may also be used with other types of surgeries, for example, ultrasonically-assisted lipoplasty, plastic surgery, reconstructive surgery, orthopaedic surgery, and other surgical procedures during which patient manipulation is desirable.

What is claimed is:

1. A method of manipulating a position of a patient during surgery, comprising providing a patient manipulation device having a plurality of elongated, substantially rigid hinged segments, placing the patient in a first position on said device such that the length of the patient's body is parallel to an axis of rotation of said hinged segments, and lifting one of said segments to rotate the patient about the length of the patient's body to a second position on said device.

2. The method of claim 1 further comprising folding another one of said segments over an edge of a surgical table on which said device and the patient are supported.

3. The method of claim 1 wherein said lifting step further comprises displacing one of said segments from beneath said patient and replacing said segment with another of said segments while rotating the patient from said first position to said second position.

4. The method of claim 1 further comprising lifting said segment using a handle disposed on said segment.

5. The method of claim 1 further comprising lifting another of said segments to rotate the patient about the length of the patient's body to a third position on said device.

6. The method of claim 1 wherein said first position is either prone or supine and said second position is a side-lying position.

7. The method of claim 1 wherein said lifting includes wrapping some of said segments partially around the patient's body.

8. The method of claim 1 wherein said lifting includes maintaining one of said segments in contact with the patient's body substantially across the width of the body.

9. The method of claim 1 further comprising securing the patient in said first position or said second position by reversibly coupling a pad to said device adjacent said patient.

10. A patient manipulation device for use in manipulating a patient on a surgical table, comprising a plurality of elongated, substantially rigid patient support segments each of which has a width substantially as large as a width of the table, said segments having longitudinal axes arranged parallel to each other, and hinges joining adjacent ones of said segments, said hinges configured for rotation of said segments about the length of the patient's body.

11. The patient manipulation device of claim 10 wherein said hinges are substantially rigid.

12. The patient manipulation device of claim 10 wherein said hinges are configured for bidirectional rotation of said segments.

13. The patient manipulation device of claim 10 wherein said hinges are configured for rotation of at least about 180° degrees about the length of the patient's body.

14. The patient manipulation device of claim 10 wherein the width of each of said segments is at least about 25% greater than the width of the table.

15. The patient manipulation device of claim 10 wherein the width of each of said segments is at least about 50% greater the width of the table.

16. The patient manipulation device of claim 10 further comprising a handle disposed on one of said segments.

17. The patient manipulation device of claim 10 further comprising a pad reversibly coupled to one of said segments to secure the position of said patient on said device.

* * * * *